US006824448B1

(12) United States Patent
Vines et al.

(10) Patent No.: US 6,824,448 B1
(45) Date of Patent: Nov. 30, 2004

(54) CMP POLISHER SUBSTRATE REMOVAL CONTROL MECHANISM AND METHOD

(75) Inventors: Landon B. Vines, San Antonio, TX (US); Parker A. Wood, Fair Oaks Ranch, TX (US); Paul Douglas, Jr., Converse, TX (US); Jesse Guzman, San Antonio, TX (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 174 days.

(21) Appl. No.: 09/871,507

(22) Filed: May 31, 2001

(51) Int. Cl.[7] ..... B24B 1/00

(52) U.S. Cl. ..... 451/36; 451/41; 451/54; 451/444

(58) Field of Search ..... 451/36, 41, 54, 451/56, 288, 287, 443, 444

(56) References Cited

U.S. PATENT DOCUMENTS 5,551,986 A 9/1996 Jain
5,597,443 A 1/1997 Hempel
5,653,622 A 8/1997 Drill et al.
5,702,563 A 12/1997 Salugsugan et al.
5,711,818 A 1/1998 Jain
5,893,753 A 4/1999 Hempel, Jr.
5,996,594 A 12/1999 Roy et al.
6,220,941 B1 4/2001 Bonner et al.
6,283,840 B1 * 9/2001 Huey ..... 451/288
6,319,098 B1 * 11/2001 Osterheld et al.

FOREIGN PATENT DOCUMENTS

EP 0967049 12/1999

* cited by examiner

*Primary Examiner*—M. Rachuba
(74) *Attorney, Agent, or Firm*—Peter Zawilski

(57) ABSTRACT

A slurry removal control mechanism for a CMP polisher is provided. After slurry dispense has been terminated, a high pressure fluid spray removes the slurry from the polishing pad, while the plated causes the pad to rotate at a high rpm rate, thus clearing the slurry from contact with the wafer. Additionally, there is provided a slurry dispense bar including high pressure spray nozzles for providing a high pressure spray upon slurry dispense termination.

12 Claims, 9 Drawing Sheets

CM P POLISHER SUBSTRATE REMOVAL CONTROL MECHANISM AND METHOD

BACKGROUND OF THE INVENTION

1. Field of the Invention

The present inventions pertain to semiconductor fabrication processing. More particularly, the present inventions relate to a system the quick removal of residue slurry and/or stagnate slurry chemical from the polishing pad during CMP processing of the wafer to control the removal rate of the substrate.

2. Description of the Prior Art

Referring now to FIGS. 1A–2, there is shown a partial perspective view of a prior art CMP machine 100 and a side partial perspective view of a wafer 105 (FIG. 2). The CMP machine 100 is fed wafers to be polished. The CMP machine 100 picks up the wafers with an arm 101 and places them onto a rotating polishing pad 102. The polishing pad 102 is made of a resilient material and is textured, often with a plurality of predetermined groves, to aid the polishing process. The polishing pad 102 rotates on a platen 104, or turn table located beneath the polishing pad 102, at a predetermined speed, usually from 30 up to 60 RPMs. A wafer is held in place on the polishing pad 102 and the arm 101 by a carrier ring and a carrier film not shown. The lower surface of the wafer 105 rests against the polishing pad 102. The upper surface of the wafer 105 is against the lower surface of the carrier film of the arm 101. As the polishing pad 102 rotates, the arm 101 rotates the wafer 105 at a predetermined rate. The arm 101 forces the wafer 105 into the polishing pad 102 with a predetermined amount of down force. The CMP machine 100 also includes a slurry dispense tube 107, extending across the radius of the polishing pad 102. The slurry dispense tube 107 dispenses a flow of slurry 106 onto the polishing pad 102.

The slurry 106 is a mixture of deionized water and polishing agents designed to aid chemically the smooth and predictable planarization of the wafer. The rotating action of both the polishing pad 102 and the wafer 105, in conjunction with the polishing action of the slurry, combine to planarize, or polish, the wafer 105 at some nominal rate. The polishing action of the slurry is comprised of an abrasive frictional component and a chemical component. The abrasive frictional component is due to the friction between the surface of the polishing pad, the surface of the wafer, and abrasive particles suspended in the slurry. The chemical component is due to the presence in the slurry of polishing agents which chemically interact with the material of the dielectric or metal layer of the wafer. The chemical component of the slurry is used to soften the surface of the dielectric layer to be polished, while the frictional component removes material from the surface of the wafer.

Slurry dispense termination is accomplished by turning off a pump, which will stop the flow of slurry onto the pad. After the slurry dispense process is terminated, the wafer substrate is still exposed to the slurry and pad. The residue slurry which was dispensed on the pad will remain on the pad and continue reacting with the wafer substrate. This will result in a non-uniform removal of the wafer substrate due to stagnate slurry on the pad. The standard removal process has a low flow stream of water is dispensed from water dispense tube 108 onto the pad, which does not remove the slurry completely and quickly from the surface of the pad. The wafer substrate is then rid of the slurry.

What is needed is a method and/or apparatus which will quickly remove the slurry from the pad, thus more accurately controlling the removal rate of the substrate.

This object, and others, is satisfied by Applicant's present inventions disclosed herebelow.

SUMMARY OF THE INVENTION

One embodiment of the present inventions relates to a method for clearing slurry from a polishing pad in a CMP process including placing a wafer substrate in contact with a polishing pad while rotating the polishing pad at a first speed. Slurry is dispensed onto the polishing pad while the pad is rotating at the first speed. After slurry dispense has terminated, a high pressure fluid is sprayed around the wafer substrates to remove slurry from between the wafer substrates and the polishing pad. The pad is rotated at a greater speed while the high pressure fluid is sprayed.

In another embodiment of the present inventions, a slurry dispense bar including a high pressure spray portion and a slurry dispense portion located over the polishing pad is provided, wherein the high pressure fluid is sprayed around said wafer substrates to remove slurry from between said wafer substrates and the pad using the high pressure spray portion of said slurry dispense bar.

Related objects and advantages of the present invention will be apparent from the following description.

BRIEF DESCRIPTION OF THE DRAWINGS

The present invention is illustrated by way of example, and not by way of limitation, in the figures of the accompanying drawings and in which like reference numerals refer to similar elements and in which.

Prior art

Prior art

DESCRIPTION OF THE PREFERRED EMBODIMENTS

Figure 1A:
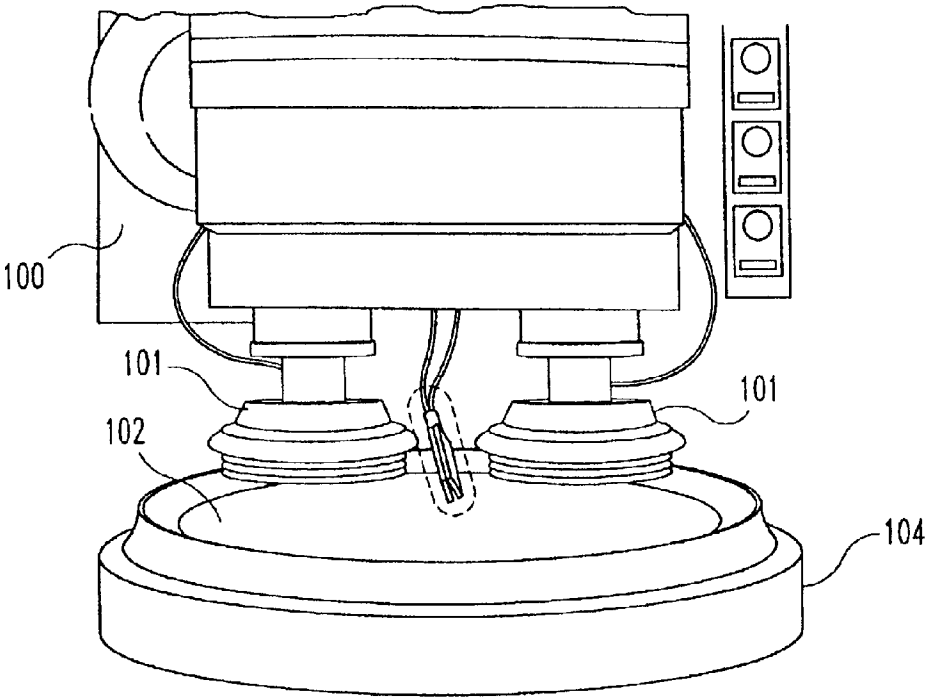
Fig. 1A (PRIOR ART)
FIG. 1A shows a partial perspective view of a prior art CMP machine.
Figure 1B:
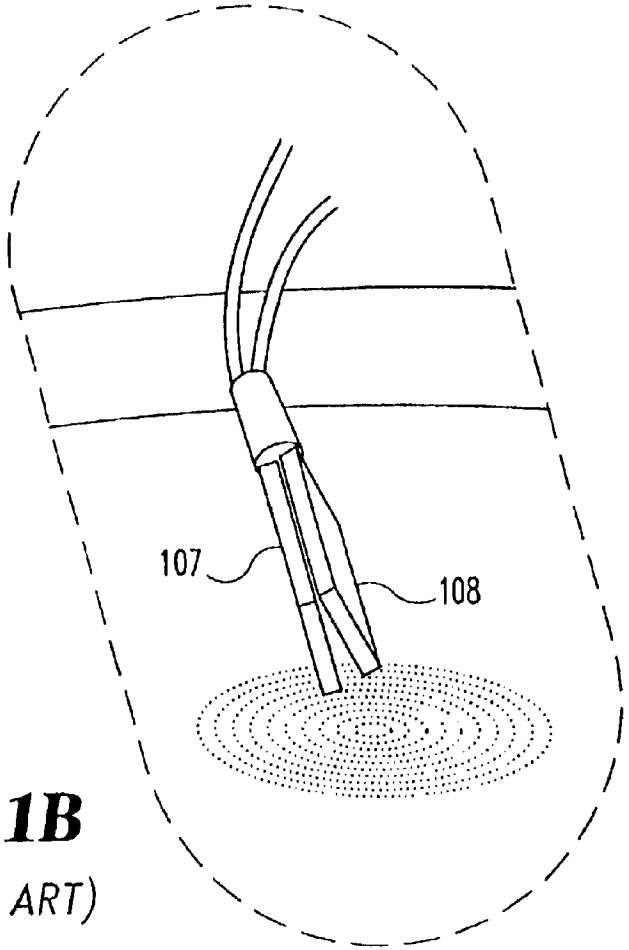
Fig. 1B (PRIOR ART)
FIG. 1B shows a partial enlarged view of the slurry and water tubes of the prior art CMP machine of FIG. 1A taken on the dotted line.
Figure 2:
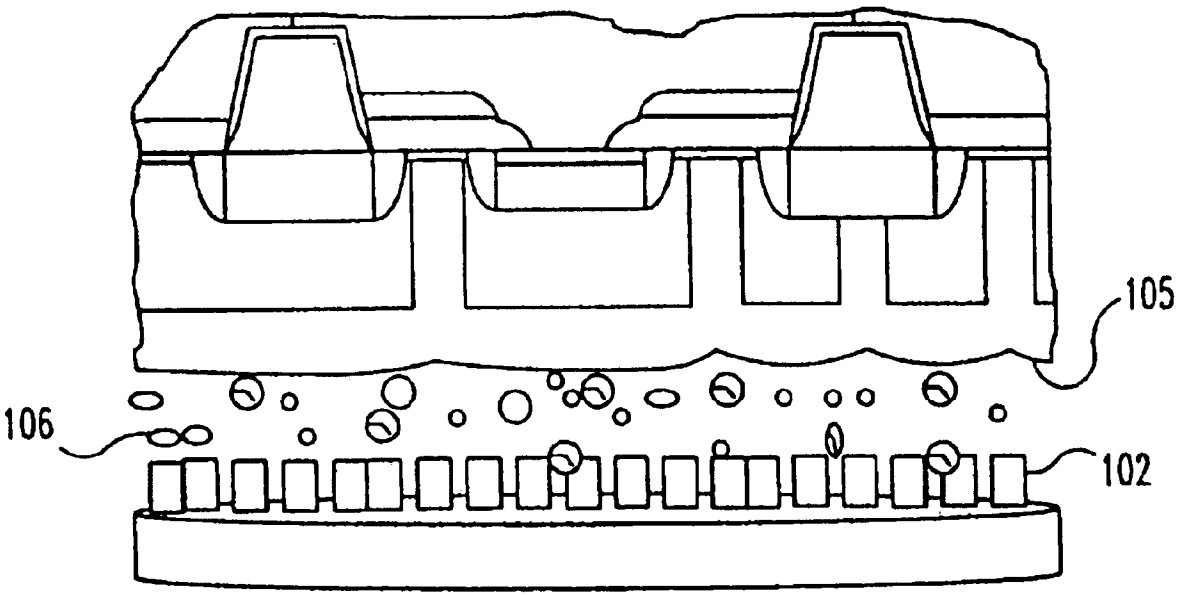
Fig. 2 (PRIOR ART)
FIG. 2 shows a partial side view of a wafer held over a portion of the rotating pad with a slurry therebetween.

For the purposes of promoting an understanding of the principles of the inventions, reference will now be made to the embodiments illustrated in the drawings and specific language will be used to describe the same. It will nevertheless be understood that no limitation of the scope of the inventions is thereby intended, such alterations and further modifications of the principles of the inventions as illustrated therein being contemplated as would normally occur to one skilled in the art to which the inventions relate.

Figure 3:
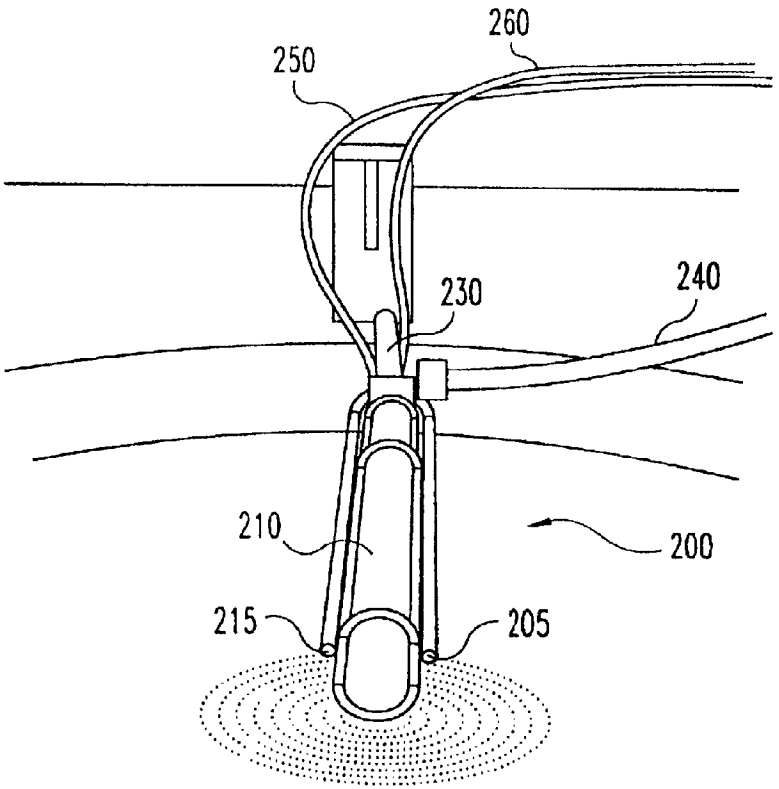
FIG. 3 shows a top view of a slurry dispense bar with high pressure spray in accordance with one embodiment of the present inventions.
Figure 4:
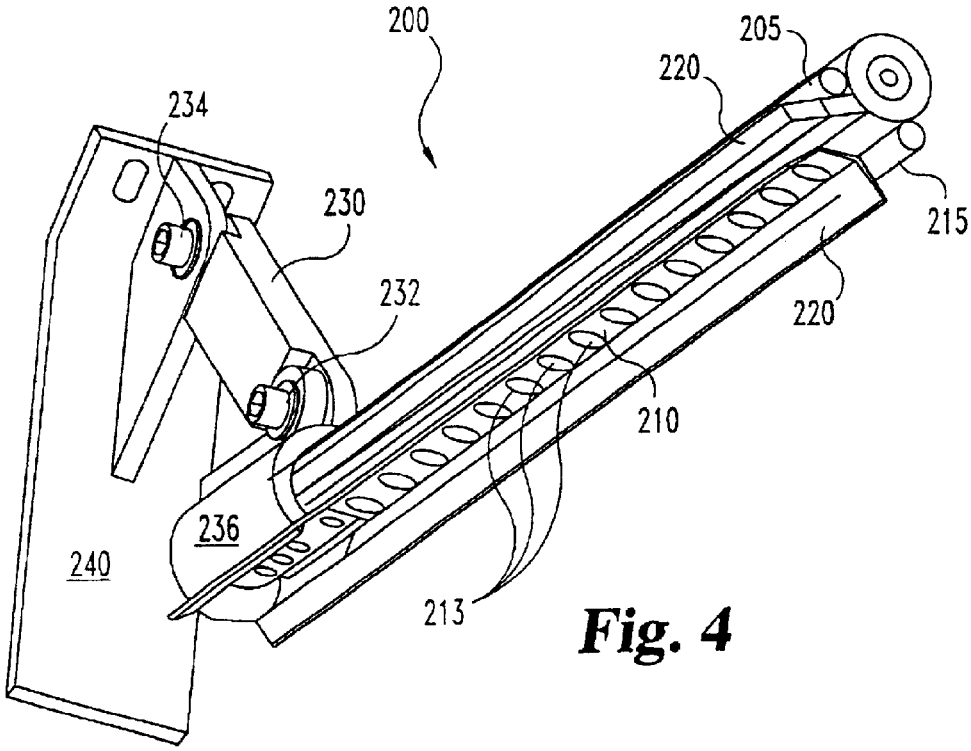
FIG. 4 shows a perspective view of the slurry dispense bar with high pressure spray of FIG. 3.

Referring now to FIGS. 3 and 4, there is shown one embodiment of the slurry dispense bar with high pressure spray of the present inventions. Slurry dispense bar 200 includes a slurry dispense tubes 205 and 215 and a high pressure spray tube 210. If desired one of slurry dispense tubes 205 and 215 could be used to dispense deionized water, or other fluids. The bar 200 additionally includes a spray guard 220 located over the high pressure spray tube 210, which prevents excessive splashing of the high pressure liquid spray. In the present embodiment the slurry dispense tubes are located on the body of the high pressure spray tube above the splash guard 220. Nozzles 213 are exemplary of the delivery holes in high pressure spray portion 210 from which the high pressure liquid is sprayed. Hole size for the slurry dispense holes and the high pressure fluid holes can be adjusted, as desired. In one particular embodiment of the present inventions, the high pressure fluid holes have a diameter of ¼ inch.

The slurry dispense bar is supported from the arm 230. In one embodiment of the present inventions, the arm 230 is mounted to a clip 236 which engages the bar 200. Alternatively, the arm 230 may be connected to the bar 200 in other ways, such as by direct bolting, welding or forming or machining with the bar. In the embodiment including clip 236, the arm 230 is hingedly connected to the clip 236 via a ferrule and bolt combination 232. Similarly, in the present embodiment, the arm 230 is hingedly connected to a mounting bracket 240, via the ferrule and bolt combination 234. The bracket 240 may be mounted to the CMP machine. Arm 230 is hinged at hinge bolts 232 and 234 so that slurry dispense bar 200 can be positioned as desired.

A high pressure fluid tube 240 brings a high pressure fluid into the high pressure spray portion 210 of the slurry dispense bar 200. Low pressure slurry and/or deionized water are brought into the slurry dispense bar by tubes 250 and 260, respectively.

Figure 5:
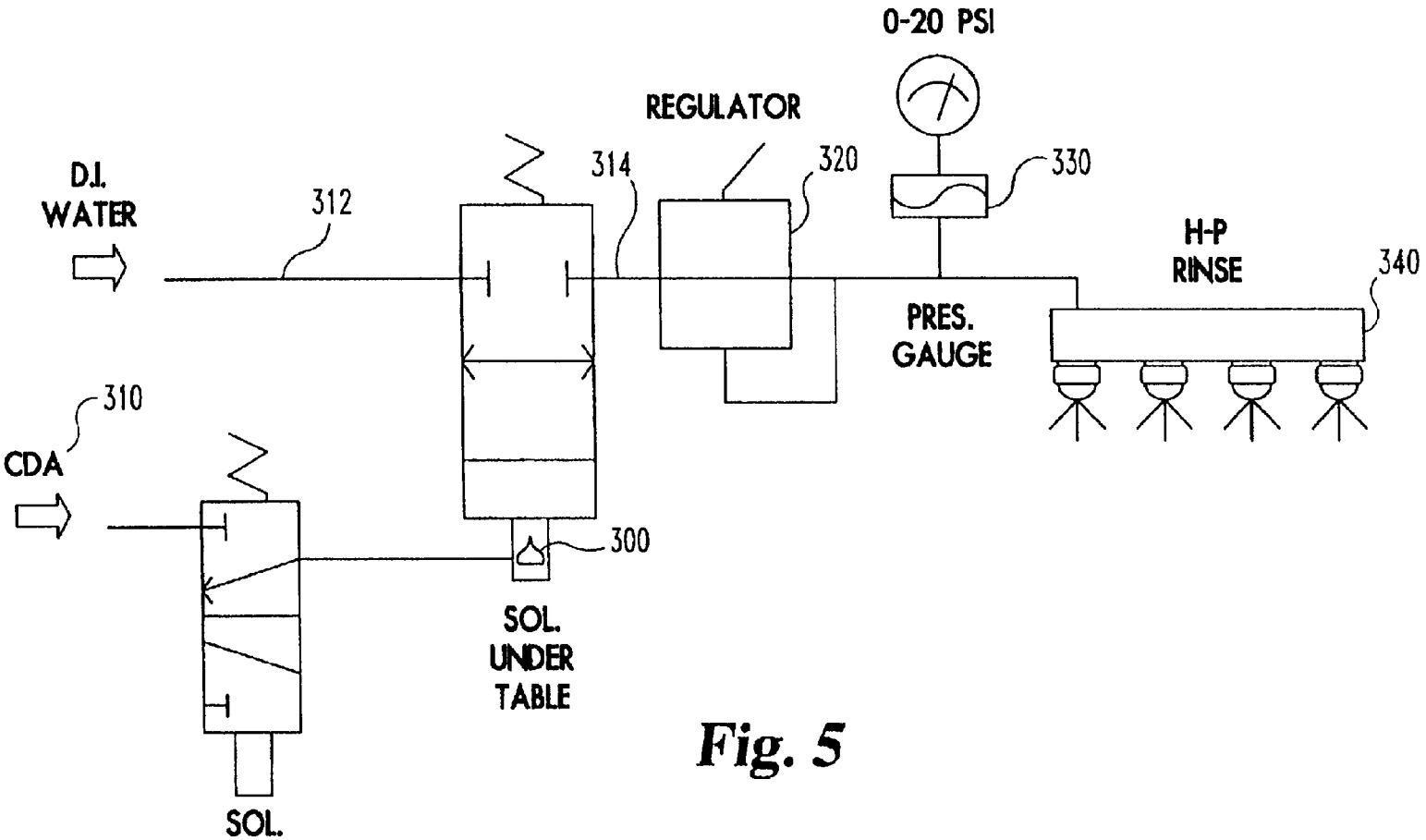
FIG. 5 shows a schematic diagram of the high pressure spray portion of the slurry dispense bar with high pressure spray in accordance with one embodiment of the present inventions.

Referring now to FIG. 5 there is a schematic diagram of the high pressure spray portion of the slurry dispense bar with high pressure spray. A solenoid 300 controls the table rinse using the high pressure fluid, which in one embodiment shown in FIG. 5 is deionized water. A compressed dry air source 310 controls the activation of the solenoid 300 based on programmed logic in the CMP machine. When activated, solenoid 300 opens a valve connecting high pressure fluid tube 312 to high pressure fluid tube 314. A regulator 320 regulates the pressure on the fluid tube 314 and is adjusted based on feedback. A pressure gauge 330 monitors the pressure of the fluid in tube 314 from between 0 and 20 PSI. In a preferred embodiment of the present inventions the high pressure spray is between 10 and 20 PSI. In a more preferred embodiment of the present inventions, the high pressure spray is about 14 PSI. The pressure gauge 330 may additionally provide the information to the regulator 320 to keep the fluid pressure regulated. The high pressure tube 314 is connected to the dispense bar high pressure spray tube 340 (210 of FIG. 4) including high pressure nozzles.

Figure 6B:
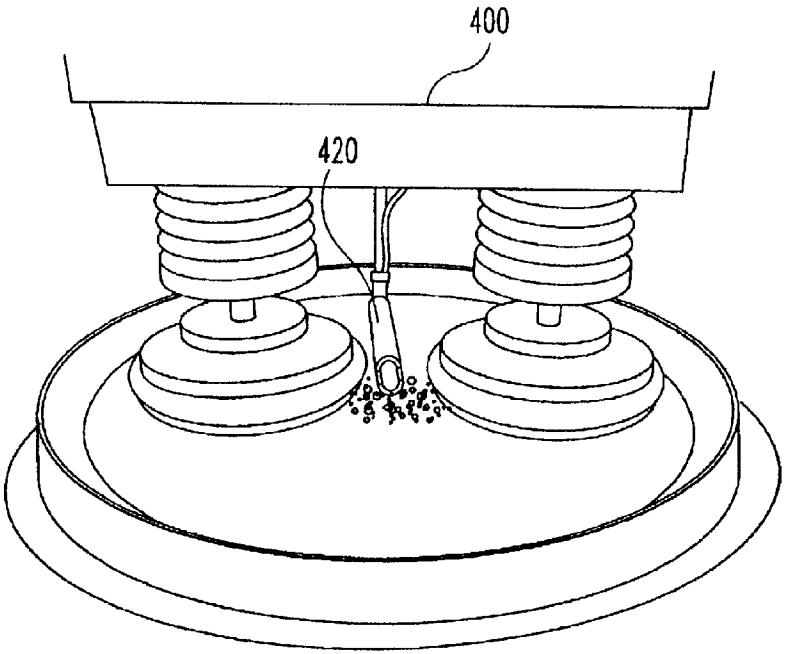
FIG. 6B shows a partial perspective view of a CMP machine including the slurry dispense bar with high pressure spray in accordance with one embodiment of the present invention.
Figure 6A:
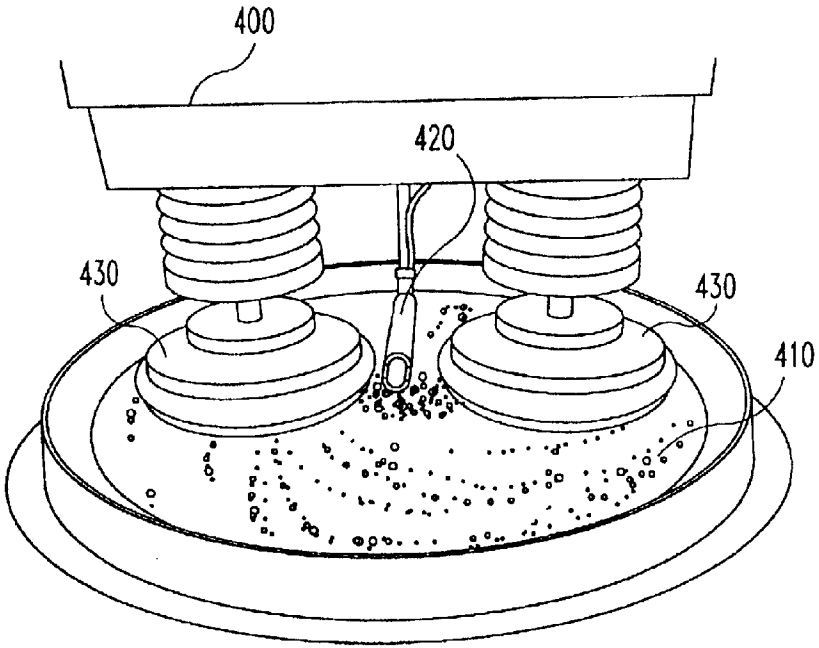
FIG. 6A shows a partial perspective view of a CMP machine including the slurry dispense bar with high pressure spray in accordance with one embodiment of the present invention.

Referring now to FIGS. 6A and 6B, there will be described a method for using a slurry bar with high-pressure spray. Referring to FIG. 6A, wafers are inversely mounted on the carrier arms 430. The slurry is dispensed onto the pad 410 through a slurry dispense tune on the spray bar 420. The wafer carriers 430 bias the wafers against the pad 410. During this time both the pad 410 and the wafer carriers 430 are rotating, with the pad 410 rotating between 30–60 RPM.

Referring now to FIG. 6B, slurry dispense is terminated by turning off a pump, which will stop the flow of slurry on to the pad. After the slurry dispense process is terminated, the wafer substrate is still exposed to the slurry and pad. At this time the solenoid (300 of FIG. 5) is activated and a high pressure fluid is sprayed onto the pad via the high pressure spray portion of the slurry dispense bar 420, while the wafer is still in contact with the slurry on the pad. In the present embodiment, the fluid is deionized water, however other fluids may be used, such as solvent, low pH or high pH chemicals and/or mixtures of those chemicals and or deionized water. During the high pressure spray, in the present embodiment of the invention, the pad 410 is rotated at a high speed of RPMs, such as between 60–200 RPMs. More preferably, the pad 410 rotates between 90 and 120 RPMs. Additionally, in one particular embodiment the high-pressure fluid is at 14 PSI. However it can be seen that the removal rate of the slurry, and thus of the substrate, can be adjusted by adjusting the pressure of the high-pressure fluid. By using high-pressure water flowing through the nozzles on the spray bar, onto the surface of the pad while rotating at a high RPM, the removal rate of the substrate will be enhanced. Additionally the quick removal of the residue chemical from the pad surface will increase the removal of particles and defects left on the surface of the pad during the CMP process. The high-pressure fluid will quickly remove the residue and/or stagnate slurry from the pad. The quick removal of the chemical from the pad results in an increase in controllability of the chemical or slurry reacting with the substrate. This improvement in uniformity of the removal rate will enhance the controllability of the CMP process, which will result in an improvement in device reliability and wafer die yields. Another benefit from the removal control mechanism of the present invention is a reduction in micro-defects in the substrate, which results in an improvement in wafer die yield. In the above-described embodiment, the high-pressure stream of fluid removes the residue slurry from the surface of the pad within one to three seconds. The volume and pressure of chemical to be sprayed on the pad will have an effect on the time to remove the residue slurry from the pad.

Figure 7:
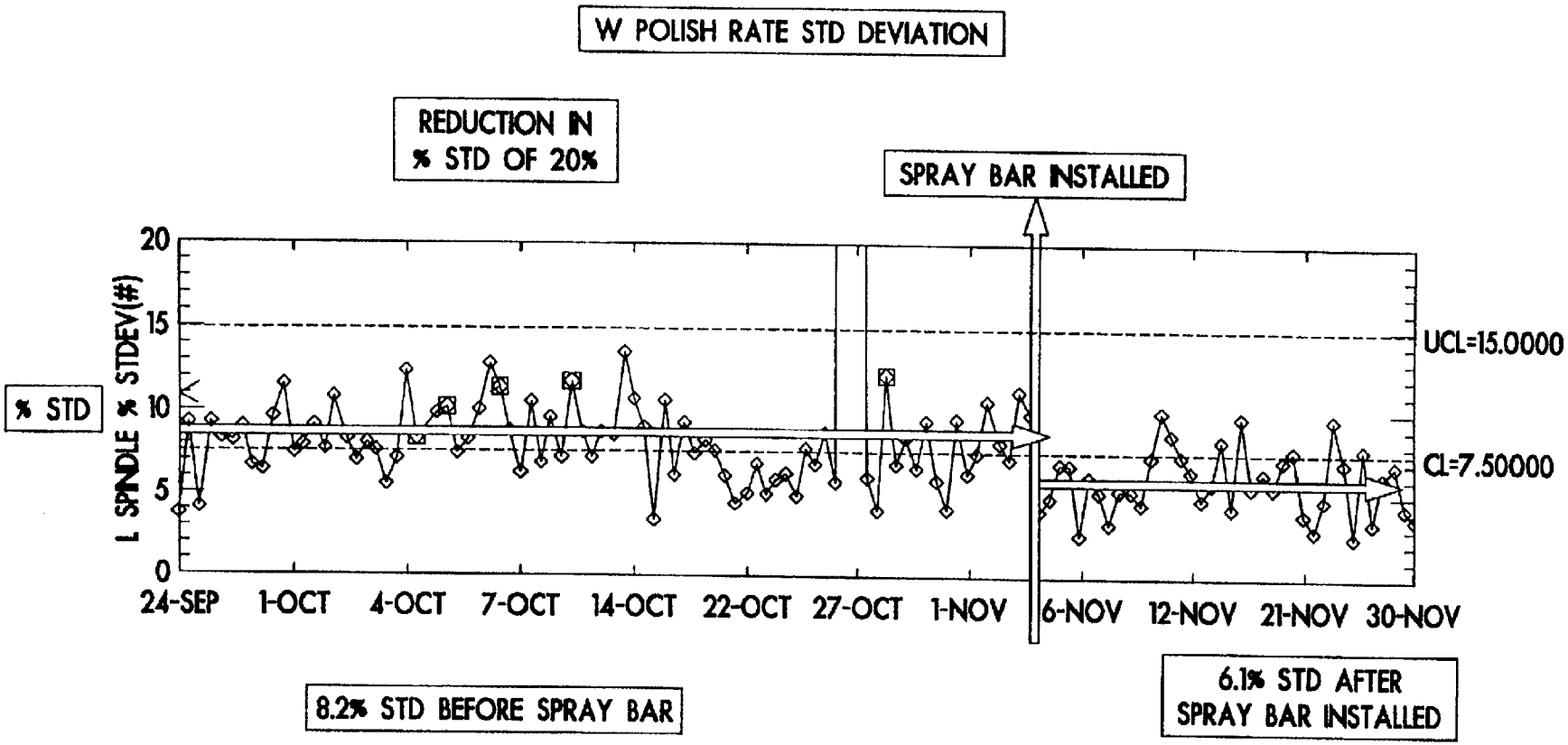
FIG. 7 shows a graph of standard deviation in polish rate before and after the installation of a slurry dispense bar with high pressure spray in accordance with one embodiment of the present invention.

Referring now to FIG. 7, there is shown a polish rate standard deviation for tungsten wafers showing the experimental results before and after the use of the spray bar of the present inventions. As shown, it was found that the polish rate standard deviation before the spray bar was 8.2% versus 6.1% after the spray bar was installed.

Figure 8:
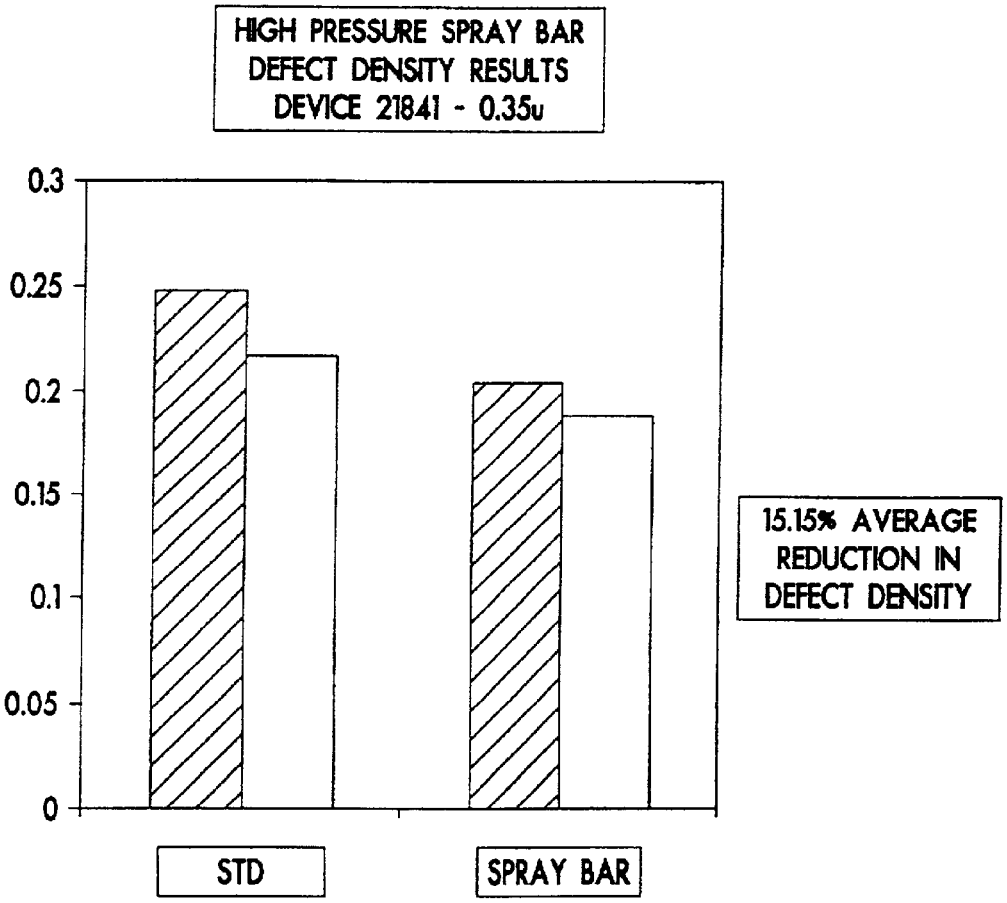
FIG. 8 is a bar showing the defect density results of the standard slurry tube method and the slurry dispense bar with high pressure spray method in accordance with one embodiment of the present inventions.

Additionally, referring now to FIG. 8, there is shown the prior art removal method defect density as compared to the high-pressure spray bar defect density. As shown, experimentally use of the slurry dispense bar with high-pressure spray of the present inventions provides for a 15.15% average reduction in defect density.

While the inventions have been illustrated and described in detail in the drawings and foregoing description, the same is to be considered as illustrative and not restrictive in character, it being understood that only the preferred embodiments have been shown and described and that a changes and modifications that come within the spirit of the invention are desired to be protected.

What is claimed is:

1. A method for clearing slurry from a polishing pad in a CMP process, comprising:

placing a wafer substrate in contact with a polishing pad;

rotating said polishing pad;

providing a slurry dispense bar including a high pressure spray portion and a slurry dispense portion located over the polishing pad;

dispensing slurry from said slurry dispense bar on said polishing pad while said pad is rotating with said wafer substrate in contact with said pad;

terminating slurry dispense; and while said wafer substrate is on the pad, spraying a high pressure fluid to remove slurry from between said water substrate and said pad with said high pressure spray portion of said slurry dispense bar.

2. The method of claim 1, wherein said high pressure spray includes water and is between 10 and 20 PSI.

3. The method of claim 2, wherein said high pressure spray is about 14 PSI.

4. The method of claim 1, including:

rotating said pad at a high speed during said spraying step.

5. The method of claim 4, wherein said high speed is between 90 and 120 RPMs.

6. The method of claim 1, wherein said slurry dispense bar includes a splash guard located above said high pressure spray portion.

7. The method or claim 6, wherein said slurry dispense portion is located above said splash guard.

8. The method of claim 7, including a second slurry dispense portion located above said splash guard.

9. A method for clearing slurry from a polishing pad in a CMP process, comprising:

placing a wafer substrate in contact with a polishing pad;

rotating said polishing pad at a first speed;

dipensing slurry onto said polishing pad while said pad it rotating with said wafer substrates in contact with said pad;

terminating slurry dispense;

while said wafer substrate is on the pad, spraying a high pressure fluid around said wafer substrate to remove slurry from between said wafer substrate and said pad using said high pressure spray portion of said slurry dispense bar; and rotating said pad at a second speed during said spraying step.

10. The method of claim 9, wherein said high pressure spray is between 10 and 20 PSI.

11. The method of claim 10, wherein said second speed is between 60 and 200 RPMs.

12. The method of claim 10, wherein said second speed is between 90 and 120 RPMs.

* * * * *